US012247466B2

(12) United States Patent
Cornelissen et al.

(10) Patent No.: US 12,247,466 B2
(45) Date of Patent: Mar. 11, 2025

(54) DOWNHOLE TOOL AND METHOD FOR PERFORATING A DOWNHOLE TUBULAR

(71) Applicant: SHELL USA, INC., Houston, TX (US)

(72) Inventors: Erik Kerst Cornelissen, Amsterdam (NL); Sam Gerard Van Moorsel, Amsterdam (NL); Coen Van Schie, Amsterdam (NL); Robert Jan Neiteler, Rijswijk (NL)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/700,191

(22) PCT Filed: Nov. 10, 2022

(86) PCT No.: PCT/EP2022/081439
§ 371 (c)(1),
(2) Date: Apr. 10, 2024

(87) PCT Pub. No.: WO2023/083946
PCT Pub. Date: May 19, 2023

(65) Prior Publication Data

US 2024/0418059 A1 Dec. 19, 2024

(30) Foreign Application Priority Data

Nov. 12, 2021 (EP) ..... 21207921

(51) Int. Cl.
*E21B 43/112* (2006.01)

(52) U.S. Cl.
CPC ..... *E21B 43/112* (2013.01)

(58) Field of Classification Search
CPC ..... E21B 43/11; E21B 43/112
See application file for complete search history.

(56) References Cited

U.S. PATENT DOCUMENTS 724,904 A * 4/1903 Mack ..... E21B 43/112 166/55.3
2,381,929 A * 8/1945 Schlumberger ..... E21B 43/112 175/2

(Continued)

FOREIGN PATENT DOCUMENTS

WO 2021170588 A1 9/2021

OTHER PUBLICATIONS

International Search Report and Written Opinion received for PCT Patent Application No. PCT/EP2022/081439, mailed on Jan. 24, 2023, 09 pages.

*Primary Examiner* — David Carroll
(74) *Attorney, Agent, or Firm* — SHELL USA, INC.

(57) ABSTRACT

A downhole tool, with an elongate tool housing that extends around a central longitudinal tool axis, houses a sting, a press device, and a bending arm. The sting is movable in a radially outward direction. The press device acts on the sting, to force the sting in the radially outward direction upon relative movement of the press device, in longitudinal direction, with respect to the sting whereby the sting may extend outside the tool housing. The sting is mounted on a distal end of the bending arm. At its proximal end the bending arm is longitudinally secured stationary relative to the tool housing. The sting and the distal end of the bending arm are movable in unison in a longitudinal-radial plane from the central longitudinal tool axis. The downhole tool can be used to perforate a wall of a downhole tubular arranged within a borehole in the Earth.

17 Claims, 2 Drawing Sheets

(56) References Cited

U.S. PATENT DOCUMENTS

| | | | | |
|---|---|---|---|---|
| 3,199,287 | A | 8/1965 | Kinley | |
| 3,301,337 | A * | 1/1967 | Vaughn | E21B 43/116 175/22 |
| 6,155,150 | A * | 12/2000 | Cooper | E21B 43/112 83/13 |
| 7,600,562 | B2 | 10/2009 | Christian | |
| 8,136,584 | B2 | 3/2012 | Burnett et al. | |
| 9,394,768 | B2 | 7/2016 | Pasvandi | |
| 9,784,078 | B2 | 10/2017 | Holly et al. | |
| 10,018,011 | B2 | 7/2018 | Van Dongen et al. | |
| 11,499,400 | B2 * | 11/2022 | George | E21B 43/112 |
| 11,851,976 | B2 * | 12/2023 | Cornelissen | E21B 43/112 |
| 2003/0070811 | A1 * | 4/2003 | Robison | E21B 43/116 166/298 |
| 2010/0078171 | A1 | 4/2010 | Moody et al. | |
| 2014/0374100 | A1 | 12/2014 | Hallundbaek et al. | |
| 2019/0264547 | A1 | 8/2019 | Cornelissen | |
| 2020/0190951 | A1 * | 6/2020 | Teurlay | E21B 43/112 |
| 2024/0052716 | A1 * | 2/2024 | Berge | E21B 23/0411 |

* cited by examiner

DOWNHOLE TOOL AND METHOD FOR PERFORATING A DOWNHOLE TUBULAR

CROSS REFERENCE TO RELATED APPLICATIONS

This is a National stage application of International Application No. PCT/EP2022/081439, filed 10 Nov. 2022, which claims priority of European Application No. 21207921.4 filed 12 Nov. 2021 which is incorporated herein by reference in its entirety.

FIELD OF THE INVENTION

In a first aspect, the present invention relates to a downhole tool for perforating a downhole tubular installed in a borehole in the Earth. In another aspect, the invention relates to method for perforating a downhole tubular arranged within a borehole in the Earth.

BACKGROUND TO THE INVENTION

In the operation of oil/gas wells or other cased boreholes in the Earth, it can often become necessary or beneficial to punch one or more holes through, or perforate, the casing which lines the well bore, or a production tubing within the casing. Tools have been proposed to perforate the casing, and to subsequently inject sealing material into the space between the Earth formation around the bore hole and the casing through the perforation or perforations formed therein. U.S. Pat. No. 2,381,929, for example, discloses a system in which punches are forced outwardly, and radially against the casing, by a pressurized fluid. The application of pressure is continued until the punches are forced through the casing.

U.S. Pat. No. 6,155,150 discloses a hydraulic tubing punch, wherein the punch is mounted on a sliding block, which can slide in radially outward direction from the tool to bring the punch in engagement with the casing wall. A wedge-shaped plunger is fixedly attached to a hydraulically driven piston. Both piston and the plunger can move in longitudinal direction through the tool. Instead of directly applying the pressurized fluid to the back of the sliding block, the wedge-shaped plunger pushes or pulls on the sliding block depending on whether it moves up or down in the longidinal direction in the tool. Longitudinal movement of the sliding block along the tool axis is prevented by sliding surfaces which only allow sliding movement of the sliding block in transverse direction relative to the tool axis.

SUMMARY OF THE INVENTION

In accordance with the invention there is provided downhole tool for perforating of a tubular installed in a borehole in the Earth, comprising:

- an elongate tool housing extending around a central longitudinal tool axis;
- at least a first sting that is movable in a first radially outward direction, away from the central longitudinal tool axis, from a first retracted position to a first extended position whereby the first sting extends to outside the elongate tool housing;
- a press device comprising a wedge, configured to act on the first sting to force the first sting in the first radially outward direction from the tool housing, transversely to the longitudinal axis, upon relative movement of the wedge, in longitudinal direction, with respect to the first sting; and
- at least a first bending arm having a first distal end on which the first sting is mounted, said first bending arm at a first proximal end thereof being longitudinally secured stationary relative to the elongate tool housing, whereby the first sting and the first distal end of the first bending arm are movable in unison in a first longitudinal-radial plane from the central longitudinal tool axis.

In a further aspect, there is provided a method of perforating a wall of a downhole tubular arranged within a borehole in the Earth, said method comprising:

- providing a downhole tool as described above;
- lowering the downhole tool into the borehole through the downhole tubular to a selected depth;
- at the selected depth, activating the press device acting on at least the first sting, whereby forcing the first sting in the first radially outward direction from the tool housing through a wall of the downhole tubular whereby perforating said wall of said downhole tubular; and
- retrieving the downhole tool from the downhole tubular.

In a preferred embodiment, there is provided downhole tool for perforating of a tubular installed in a borehole in the Earth, comprising:

- an elongate tool housing extending around a central longitudinal tool axis;
- a first sting-arm combination comprising a first pair of a first sting and a first bending arm, wherein:
  - the first sting is movable in a first radially outward direction, away from the central longitudinal tool axis, from a first retracted position to a first extended position whereby the first sting extends to outside the elongate tool housing; and wherein
  - the first bending arm has a first distal end on which the first sting is mounted, said first bending arm at a first proximal end thereof being longitudinally secured stationary relative to the elongate tool housing, whereby the first sting and the first distal end of the first bending arm are movable in unison in a first longitudinal-radial plane from the central longitudinal tool axis;

the downhole tool further comprising:

- a second sting-arm combination comprising a second pair of a second sting and a second bending arm, wherein:
  - the second sting is movable in a second radially outward direction, away from the central longitudinal tool axis, from a second retracted position to a second extended position whereby the second sting extends to outside the elongate tool housing;
  - the second bending arm has a second distal end on which the second sting is mounted, said second bending arm at a second proximal end thereof being longitudinally secured stationary relative to the elongate tool housing, whereby the second sting and the second distal end of the second bending arm are movable in unison in a second longitudinal-radial plane from the central longitudinal tool axis;

and wherein said first sting-arm combination and second sting-arm combination are arranged side-by-side whereby the first sting and the second sting are positioned in one transverse plane but at mutually differing azimuths around the central longitudinal tool axis;

the downhole tool further comprising:

- a press device comprising a first wedge segment and a second wedge segment, slidingly abutted against said first wedge segment in a longitudinal-radial abutment plane, whereby the first wedge segment is in sliding contact with the first sting-arm combination and whereby the second wedge segment is in sliding contact with the second sting-arm combination, whereby the first wedge segment is configured to act on the first sting to force the first sting in the first radially outward direction from the tool housing, transversely to the longitudinal axis, upon relative movement of the first wedge segment, in longitudinal direction, with respect to the first sting, and whereby the second wedge segment is configured to act on the second sting to force the second sting in the second radially outward direction from the tool housing, transversely to the longitudinal axis, upon relative movement of the second wedge segment, in longitudinal direction, with respect to the second sting;

and wherein the first wedge segment and the second wedge segment are free to slidingly move relative to each other in the longitudinal direction when being forced into relative movement with respect to the first and second stings, in longitudinal direction parallel to the central longitudinal tool axis.

Activating the press device in the preferred embodiment leads to forcing the first sting in the first radially outward direction from the tool housing through a wall of the downhole tubular and forcing the second sting in the second radially outward direction from the tool housing through the wall of the downhole tubular, whereby perforating said wall of said downhole tubular in multiple locations.

These and other features, embodiments and advantages of the method, and of suitable expansion devices, are described in the accompanying claims, abstract and the following detailed description of non-limiting embodiments depicted in the accompanying drawings, in which description reference numerals are used which refer to corresponding reference numerals that are depicted in the drawings.

BRIEF DESCRIPTION OF THE DRAWINGS

The drawing figures depict one or more implementations in accordance with the present teachings, by way of example only, not by way of limitation. In the figures, like reference numerals refer to the same or similar elements.

Figure 1:
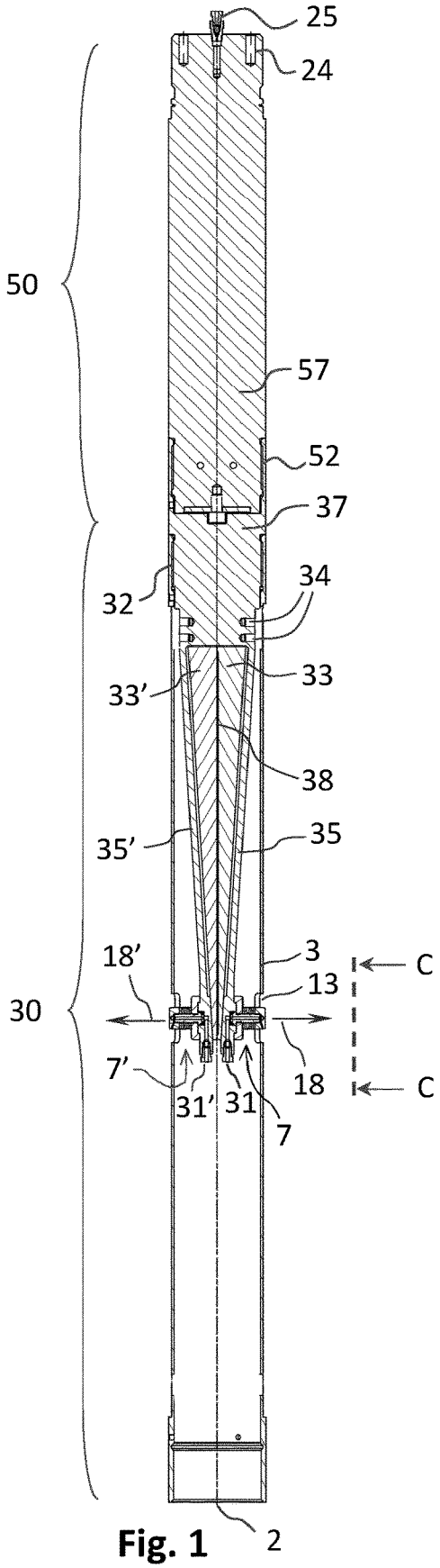
FIG. 1 is schematic cross sectional view along line B-B indicated in FIG. 2, of a section of a downhole tool for perforating of a tubular.

Similar reference numerals in different figures denote the same or similar objects. Objects and other features depicted in the figures and/or described in this specification, abstract and/or claims may be combined in different ways by a person skilled in the art. Unless otherwise indicated, the term longitudinal is used herein to express the direction parallel to the central longitudinal tool axis, and the term transverse is used to express any direction normal (perpendicular) to the central longitudinal tool axis.

DETAILED DESCRIPTION OF THE INVENTION

Proposed is a downhole tool, with an elongate tool housing that extends around a central longitudinal tool axis, houses a sting, a press device, and a bending arm. The downhole tool may be run longitudinally in a bore of a downhole tubular arranged within a borehole in the Earth. The downhole tool can be used to perforate a wall of the downhole tubular.

The sting is movable in a radially outward direction, and capable of perforating the wall of the wellbore tubular. The press device acts on the sting, to force the sting in the radially outward direction upon relative movement of the press device, in longitudinal direction, with respect to the sting whereby the sting may extend outside the tool housing. The sting is mounted on a distal end of the bending arm. At its proximal end, the bending arm is secured longitudinally stationary relative to the tool housing. However, the sting and the distal end of the bending arm are movable in unison in a longitudinal-radial plane from the central longitudinal tool axis. Any axial force transmitted from the surface of the longitudinally moving wedge to the distal end and the sting is thus balanced by tension in the bending arm. The axial force does not need to be countered by any sliding surface.

In use, the tool may be lowered into a borehole through the bore of the downhole tubular, to a selected depth. At the selected depth, the tool may be kept stationary, while activating the press device acting on the sting. Thus, the sting is forced in the radially outward direction from the tool housing, into contact with the wall of the downhole tubular and subsequently perforating the wall of the downhole tubular. At least part of the sting may be subsequently retracted, and the downhole tool may then be retrieved from the downhole tubular.

Typical downhole tubulars include wellbore tubulars, such as, for example, casing, liner, or production tubing.

The method and downhole tool described herein can be used to install a functional plug in a wall of a downhole tubular (e.g. casing or production tubing). Such functional plug may for example include an orifice or nozzle, and/or a non-return valve, to be able to pass a fluid through the wall from the inside of the tubular to the surrounding and/or in the other direction. Applications for such functional plug include (gas) lift operations and injecting of an treatment fluid such as a sealant.

The method and downhole tool described herein may be used for subsequently injecting a treatment fluid in an annulus surrounding the downhole tubular.

Figure 2:
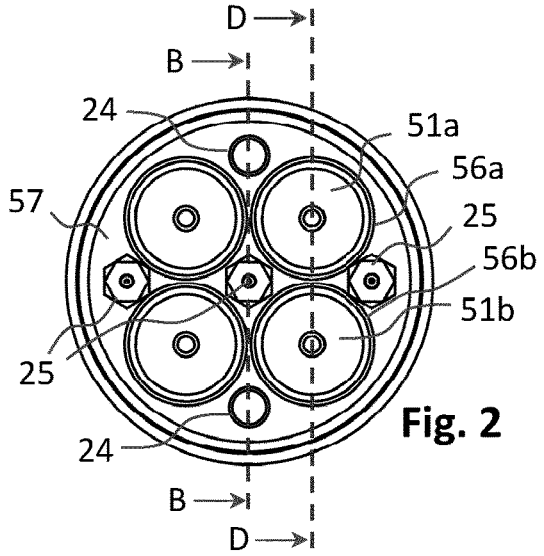
FIG. 2 is a plan view on the tool of FIG. 1 along a longitudinal direction from above.

FIG. 1 shows a cross sectional view of an example of a section of the downhole tool. The cross section is taken along line B-B as indicated in FIG. 2. For reason of clarity, some of the parts that are not essential to the present invention have been omitted or simplified.

The tool can be of modular design, having several sections (or: modules) which can be assembled to form a tool string using connectors. Shown in FIG. 1 are an expander section 30 and a piston section 50 joined together. The piston section 50 is connected to the expander section 30 at connector 52. The expander section 30 comprises a base 37, to which, in turn, an elongate tool housing 3 is connected at connector 32. The tool housing 3 is extending around a central longitudinal tool axis 2. The tool can be run downhole in a downhole tubular, such as a wellbore tubular.

Connectors, such as for example screw connectors 34 in the base 37, may be provided to attach an optional external centralizer, such as a (flexible) spring blade (not shown).

The expander section 30 furthermore comprises a sting 7. The sting 7 is movable in a radially outward direction 18, away from the central longitudinal tool axis 2, from a retracted position (as shown) to an extended position (not shown), whereby the sting 7 partly extends to outside the elongate tool housing 3. A window 13 may suitably be provided in the elongate tool housing 13 to allow passage of the sting 7. A press device, comprising a wedge (here, embodied in first wedge segment 33), acts on the sting 7 to force the sting 7 in the radially outward direction 18 from the tool housing 3. The movement of the sting 7 is driven by movement of the first wedge segment 33 in longitudinal direction with respect to elongate housing 3 and the sting 7. The radially outward direction 18 is in essence transverse to the longitudinal axis 2. The sting 7 is rigidly mounted on a distal end of a bending arm 35. At a proximal end thereof, the bending arm 35 is fixed longitudinally stationary relative to the elongate tool housing 3. In the embodiment as shown, the bending arm 35 is monolithic to the base 37. This can be made by machining.

The sting 7 and the distal end of the bending arm 35 are movable in unison in a longitudinal-radial plane from the central longitudinal tool axis 2. As a result, the sting 7 can move in said radial outward direction 18, essentially without experiencing any friction in the transverse direction. The bending arm 35 effectively acts as a spring blade, which is elastically loaded as the press device forces the sting 7 in the radially outward direction 18.

The expander section 30 may comprise multiple sting-arm combinations, each with their own press device. For example, in the embodiment of FIG. 1, the already mentioned sting 7 and bending arm 35 together form a first sting-arm combination, whereby the tool further comprises a second sting-arm combination comprising a second sting 7' and a second bending arm 35'. The second sting comprises, wherein said second sting is movable in a second radially outward direction 18' opposite to the first radially outward direction 18 and also away from the central longitudinal tool axis 2. The first sting-arm combination and second sting-arm combination are arranged side-by-side, whereby the first sting and the second sting are positioned in one transverse plane 28, but at mutually differing azimuths around the central longitudinal tool axis 2. The transverse plane is transverse to the central longitudinal axis. Both press devices act on both sting-arm combinations simultaneously, to force the first sting and second sting in mutually differing radially outward directions from the tool housing, transversely to the longitudinal axis.

Each press device includes its own wedge segment. Two such wedge segments are shown in FIG. 1: the first wedge segment 33 and a second wedge segment 33'. The first wedge segment 33 and second wedge segment 33' are slidingly abutted against each other in a longitudinal-radial abutment plane 38, whereby the first wedge segment 33 is in sliding contact with the first sting-arm combination (7,35) and whereby the second segment 33' is in sliding contact with the second sting-arm combination (7',35'). When being forced into relative movement, in longitudinal direction, with respect to the first sting 7 and second sting 7', the first wedge segment 33 and the second wedge segment 33' are also free to slidingly move, relative to each other, in the longitudinal direction.

An inlay 36, consisting of sheet or platelet of a wear resistant contact material, may be provided in a recess in one of the wedge segments at the abutment plane 38. The inlay 36 may be best visible in the detailed cross sectional view of FIG. 3. The inlay may be made of a material having a high degree of wear resistance and/or a low coefficient of friction. Other beneficial properties for this material include one or more of a high mechanical strength, stiffness, and hardness. Furthermore, it may have high temperature resistance and a good creep resistance at high temperatures. Examples of preferred materials include PEEK (a polyetheretherketone material), preferably bearing grade (BG) PEEK, which may be reinforced with carbon fiber.

The bending arms 35,35' are flexible, such that upon movement of the respective wedge segments 33,33' the bending arms 35,35' flex or pivot outward, such that each sting 7,7' is movable in unison with the distal ends of the bending arms in a longitudinal-radial plane from the longitudinal tool axis 2. The bending arms 35,35' may flex fully elastically, or the flexing may be assisted by a pivot. Elastic bending has the advantage that the bending arms will automatically retract when the wedge segments 33,33' are returned to their starting positions.

With the tool ran concentrically inside a downhole tubular installed in a borehole in the Earth, the stings will first engage with the inside of the wall of the tubular and after continued forcing the wedge segments the stings will ultimately, one after the other, perforate the wall of the tubular and protrude through the tubular into the annular space surrounding the tubular.

Figure 3:
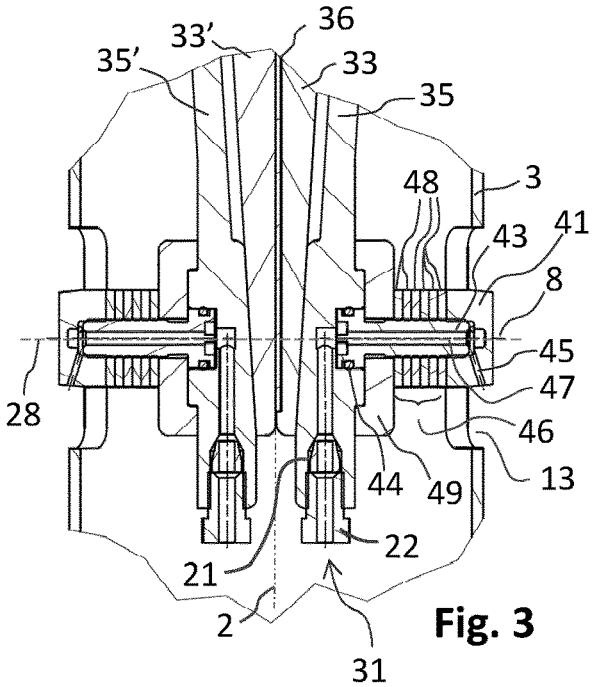
FIG. 3 is a detailed cross sectional view of the sting-arm combinations of the tool of FIG. 1.

As can also be seen in FIG. 3, in this particular example, a major part of the sting 7 is cylindrical and extends along a longitudinal sting axis 8. The longitudinal sting axis 8 is in essence perpendicular to the central longitudinal tool axis 2, and extending radially outward therefrom in the transverse plane 28. The end cap 41 may comprise an orifice, a nozzle, and/or house a non-return valve. The sting 7 may comprise an end cap 41, which might be slightly tapered at the radially outward facing surface. The sting 7 is held in place by a sting foot 49, which may, for example, be bolted to the distal end of the bending arm 35.

Figure 4:
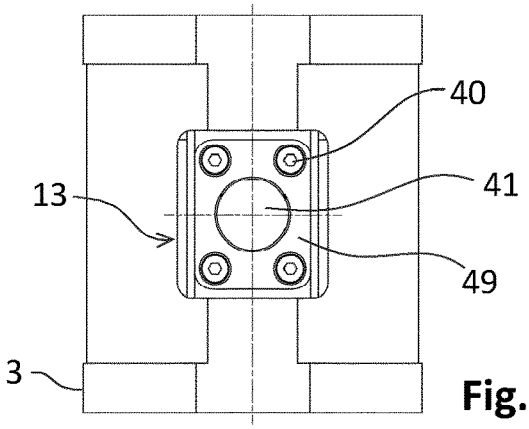
FIG. 4 is a plan view along line C-C indicated in FIG. 1.

FIG. 4 shows a side view of the tool from the direction indicated by C-C in FIG. 1. Both the end cap 41 of the sting 7, and the sting foot 49 can be seen through window 13 in tool housing 3. The window 13 is preferably sufficiently large to receive the sting foot 49 when the sting is in the extended position. Bolts 40 may be employed to mount the sting 7 to the bending arm.

The wedge segments 33,33' each engage with a hydraulic piston, which may be housed within the piston section 50. The hydraulic piston can be actuated by a hydraulic fluid that is displaced by a pump, to impart the relative movement of the wedge segments, in longitudinal direction, with respect to each of the stings 7,7'. Advantageously, each of the wedge segments 33,33' engages with a plurality of hydraulic pistons.

Figure 5:
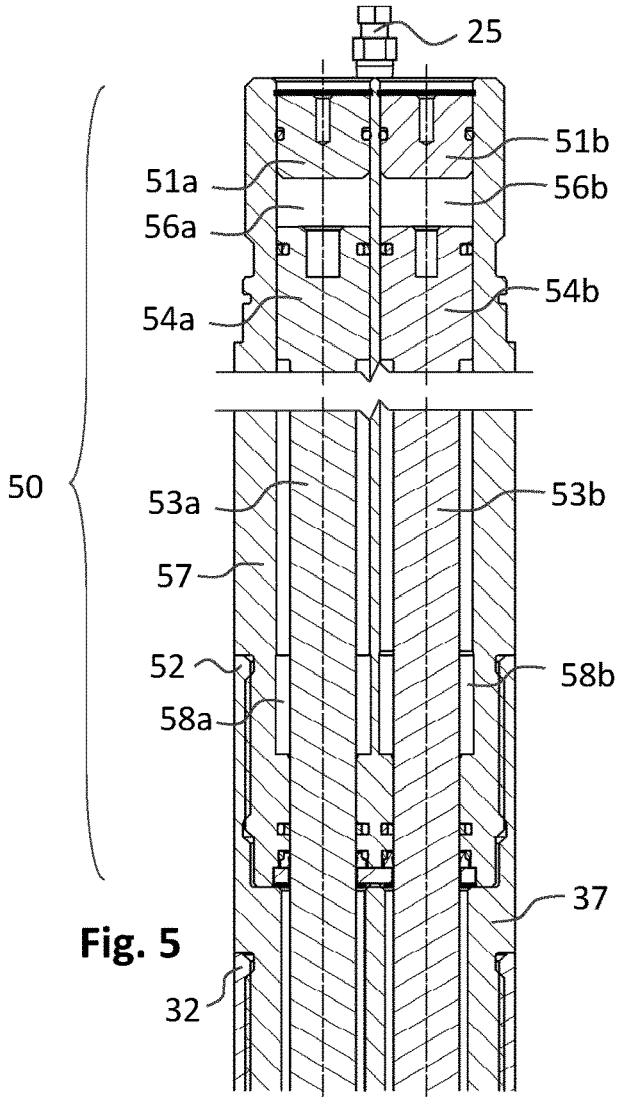
FIG. 5 is a detailed cross sectional view of the tool along line D-D as indicated in FIG. 2.

Focusing now on FIG. 5, there is illustrated a cross-section of the piston section 50 shown in FIG. 1 but along the line D-D as indicated in FIG. 2. The cross-section view also shows part of the base 37. The piston section 50 comprises a piston housing 57 provided with one or more piston bores 56*a*, 56*b*. Piston rods 53*a* and 53*b* traverse the base 37, and both piston rods engage with the wedge segment 33. Hydraulic pistons 54*a* and 54*b* are respectively formed at the other ends of the piston rods 53*a* and 53*b*. The hydraulic pistons 54*a*,54*b* are slidingly arranged in the piston bores 56*a*,56*b*. The piston bores are sealed off by piston plugs 51*a* and 51*b* sealed in place with O-rings or the like. The pistons 54*a* and 54*b*, are actuated by a hydraulic fluid which can be introduced in the piston bores between the piston plugs 51*a*, 51*b* and the hydraulic pistons 54*a*, 54*b*. The hydraulic fluid is displaced by the pump. The wedge segments can be retracted by hydraulically actuating pistons 54*a* and 54*b* to move towards the piston plugs (51*a*,51*b*), by pumping hydraulic fluid in the piston rod annuli (58*a*,58*b*) that exist between the piston rods (53*a*,53*b*) and the piston bore walls. Valves to direct the hydraulic fluid flow may be provided in a separate tool section (not shown). The hydraulic pump may also be provided in a separate tool section (not shown).

When two wedge segments 33 and 33' have to be actuated, the above described hydraulic pistons 54*a*,54*b* together act as a first piston engaging with the first wedge segment 33, while similar hydraulic pistons together form a second piston engaging with the second wedge segment 33'. The hydraulic fluid, which is displaced by the hydraulic pump, can be distributed over all available piston bores. Referring now to FIG. 2, it can be geometrically understood that the total combined area available for the two piston bores 56*a* and 56*b* for the "first piston" (i.e. two times two piston bores, for two wedge segments of the tool) is larger than the area available for a single circular piston bore per wedge segment would be (i.e. two times one single piston bore). This allows for more available force on the stings. Moreover, each being held by two piston rods instead of one, the wedge segments will be more rigid and stable against force components in the direction perpendicular to the cross section cut plane of FIG. 1. On the other hand, some relative flexibility is provided on the wedge segments to react to net force components in one of the radially outward directions 18,18'. Under normal conditions, the forces in the radially outward directions 18,18' counter each other, but when one of the stings 7,7' starts to advance into the wall of a wellbore tubular then temporarily a net force may present itself. By providing wedge segments 33,33' that slide relatively to each other, instead of a solid single wedge, strains that would be caused by the resulting net force can be more easily accommodated.

Also visible in FIG. 2 are screw holes 24 to facilitate positioning of another tool section (e.g. a hydraulic section with a pump and/or valves), and three hydraulic fluid connectors 25, which can be used to convey pressurized hydraulic fluid from a reservoir, using a pump and/or valve segment of the tool (not shown), to the piston bore(s) and to convey a return stream from the piston rod annulus or annuli back to a return reservoir, or vice versa. A third hydraulic fluid connector 25 is optional, and may be used to convey pressurized hydraulic fluid from the reservoir to one or more treatment fluid canisters, as will be further elaborated on below. The hydraulic fluid connectors 25 engage with hydraulic fluid channels (e.g. bores) provided within the piston housing.

Referring, again, to FIG. 3, the sting 7 (or each of the stings) may optionally comprise an injection tube 43 comprising a fluid channel 47, to establish fluid communication from within the tool housing 3 to an exterior of the tool housing through the fluid channel 47. The fluid channel 47 within the injection tube 43 may suitably connect to a discharge nozzle 45 via check valve (suitably a biased ball valve, not shown), which may be provided, for example, within the end cap 41. The fluid channel can be connected to a treatment fluid canister via flexible line (not shown) that can be plugged into a socket 31. Such socket 31 may suitably comprise a compression fitting in which a ferrule 21 is compressed around an end of the flexible line as a nut 22 is tightened. The injection tube 43 may be held in place by the sting foot 49, which may, for example, be bolted to the distal end of the bending arm 35. An O-ring seal 44 may be provided to avoid leakage of treatment fluid which is passed from the socket 31 into the fluid channel 47. This is only one example of how the sting can be mounted onto the bending arm, and alternative constructions to rigidly mount the sting to the bending arm are assumed to be in reach of the skilled person based on the present teaching. A frangible zone 46 may comprise reinforcement rings 48 stacked around the injection tube 43, in mutual abutment with each other. The sting of FIG. 3 is modelled after the sting shown disclosed in WO2020/229440A1, and modified to fit in the tool as described herein.

The injection tube 43 and fluid channel 47 are optional. However, in case injection tube 43 and fluid channel 47 are provided, a canister may be provided for storing the treatment fluid. The canister may be in selective fluid communication with a hydraulic pump, via a selectable valve which selectively isolates the canister from the pump or opens the canister to the pump. The hydraulic fluid may push the treatment fluid from the canister to one or both of the stings 7,7', by displacing and replacing the treatment fluid inside the canister. A piston separator may be provided within the canister to separate the treatment fluid from the hydraulic fluid and to avoid contamination of the treatment fluid by the hydraulic fluid. The pump may be the same pump as the one utilized for actuating the press device, as the pump's duty for actuating the press device will not be necessary when the sting is in its extended position.

Figure 6:
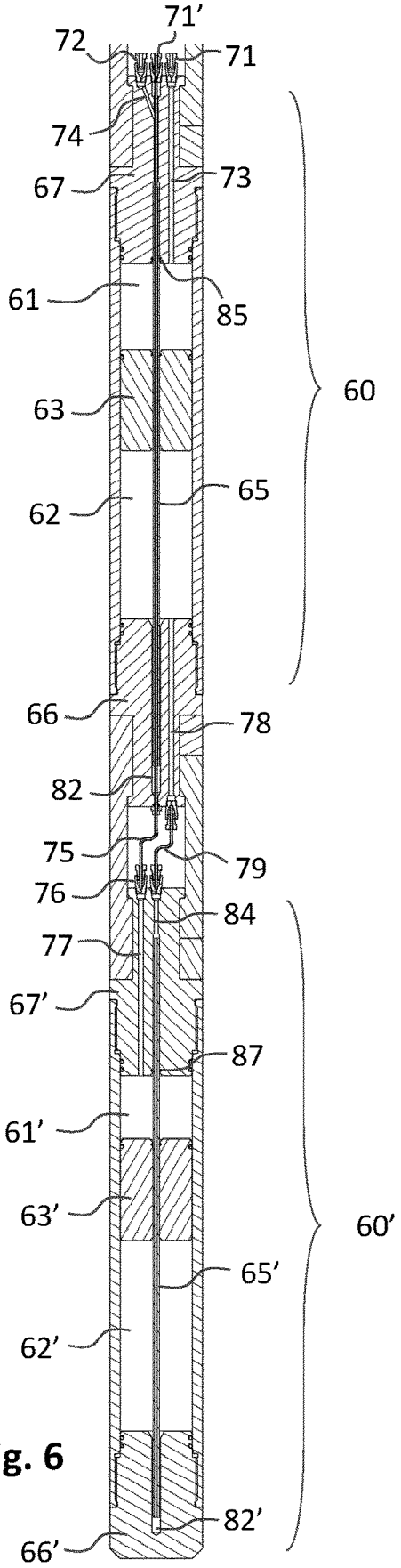
FIG. 6 is a detailed cross sectional view of the canisters that can be connected to the tool of FIG. 1.

FIG. 6 shows a cross section of how such a canister may be implemented on the tool of FIG. 1, which has two stings. This canister comprises a treatment fluid first reservoir 61 and a treatment fluid second reservoir 61', a hydraulic fluid first reservoir 62 and a hydraulic fluid second reservoir 62', a first piston separator 63 and a second separator piston 63', a first canister head 66 and a second canister head 66', a first canister base 67 and a second canister base 67'. The first piston separator 63 is slidable in longitudinal direction over a first central hydraulic fluid tube 65 and the second piston separator 63' is slidable in the longitudinal direction over a second central hydraulic fluid tube 65'.

The first canister base 67 is provided with a hydraulic fluid connector 72 for supply of pressurized hydraulic fluid from the pump, and with a treatment fluid first connector 71 and a treatment fluid second connector 71'. The latter two may respectively be fluidly connected to sockets 31 and 31' via treatment fluid connection lines (not shown). These treatment fluid connection lines are suitably flexible, to allow for the transition of the stings 7,7' from their respective retracted position to extended position.

The treatment fluid first connector 71 communicates via a bore 73 through the first canister base 67 to the treatment fluid first reservoir 61. Inside the first central hydraulic fluid tube 65, an inner tube 75 extends from the treatment fluid second connector 71' to connector 76 provided in the second canister base 67'. This communicates via a bore 77 through the second canister base 67' to the treatment fluid second reservoir 61'. The hydraulic fluid connector 72 communicates via bore 74 and the first central hydraulic fluid tube 65 to a hydraulic fluid first annulus 82 in the first canister head 66 which extends between the first central hydraulic fluid tube 65 and the first canister head 66. From there, the hydraulic fluid can pass via the hydraulic fluid first annulus 82 into the hydraulic fluid first reservoir 62. The bore 74 is suitably sealed off, for example by means of O-ring 85, from the treatment fluid first reservoir 61 to avoid contamination of the treatment fluid inside the treatment fluid first reservoir 61 with the hydraulic fluid passing through bore 74.

The hydraulic fluid first reservoir 62 is fluidly connected to the hydraulic fluid second reservoir 62' as follows. Via bore 78 though the first canister head 66 and liner 79 a hydraulic fluid connection is established to bore 84 in the second canister base 67' and the second central hydraulic fluid tube 65'. Bore 84 is suitably sealed off from the treatment fluid second reservoir 61', for example with O-ring 87 or other type of seal. From the second central hydraulic fluid tube 65', the hydraulic fluid can enter into the hydraulic fluid second reservoir 62' via annulus 82' extending between the second central hydraulic fluid tube 65' and the second canister head 66'.

Both the first canister 60 and the second canister 60' are in selective fluid communication with the hydraulic fluid pump. During use, a selectable valve selectively isolates both the first canister 60 and second canister 60' from the pump or opens both the first canister 60 and the second canister 60' to the pump. When selectively opened to the pump, both the hydraulic fluid first reservoir 62 and the hydraulic fluid second reservoir 62' fill with the hydraulic fluid when the canister is opened to the pump. The first canister 60 is in fluid communication with the first sting 7 with a second treatment fluid connection line (not shown) extending between the treatment fluid first connector 71 and socket 31. The second canister 60' is in fluid communication with the second sting 7' with a second treatment fluid connection line (not shown) extending between the treatment fluid second connector 71' and socket 31'. The second treatment fluid connection line bypasses the first treatment fluid connection line and the first sting 7.

An advantage of providing a dedicated canister (or dedicated set of canisters) for each of the stings, it is achieved that the treatment fluid is injected through each sting in predetermined quantities, preferably in mutually equal quantities. If multiple stings would be fed by a shared canister, imbalances may cause the treatment fluid to pass preferentially through one of the stings, thereby filling the annulus surrounding the downhole tubular less homogenously. Imbalances may be caused, for example, by one of the stings experiencing a higher flow resistance than the other. By feeding each sting from a different canister, it is believed a more controllable and homogenous distribution of the treatment fluid around the tubular can be feasible.

The treatment fluid may for example be a two-component resin, the components of which being mixed during the injection of the treatment fluid. In this case, multiple canisters may be provided for each of the stings. Alternatively, a resin may be employed which hardens in contact with a wellbore fluid, such as water. Examples are described in International publication No. WO2021/170588A1. In such cases, a single canister per string could suffice.

Figure 7:
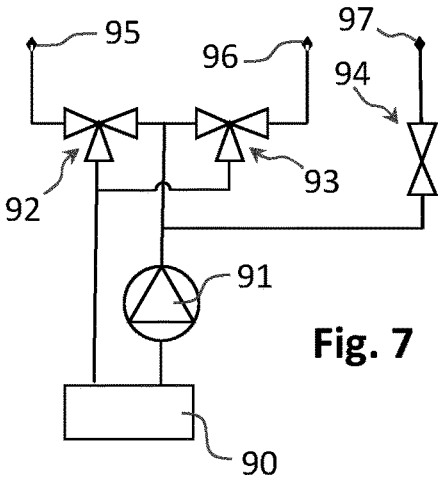
FIG. 7 is an example hydraulic circuit for use in the tool of FIG. 1.

FIG. 7 shows one non-limiting example of how the hydraulic circuit can be designed. The associated pump and valves may be packaged in a separate tool section. The hydraulic fluid is provided in a pressure-compensated reservoir 90 where the pressure is kept equal to the pressure outside of the elongate tool housing 3. Pump 91 is provided to displace the hydraulic fluid. In this example, the pump 91 is a unidirectional pump. The outlet of pump 91 is split to two three-way valves 92,93 and a selectable valve 94. Two other connections of the three-way valves 92,93 are respectively connected directly to the pressure-compensated reservoir 90 (bypassing the pump 91), and the third connectors of the three-way valves are in connection with respectively connectors 95 and 96. These may be joined with two of the hydraulic fluid connectors 25. For example, connector 95 may be joined with the hydraulic fluid connector 25 which is in fluid communication with piston bores 56*a*, 56*b*, while connector 96 is joined with the hydraulic fluid connector 25 which is in fluid communication with the piston rod annuli 58*a*,58*b*, as shown in FIG. 5 (and similar other piston bores and piston rod annuli of other press devices provided in the tool). The outlet of the selectable valve 94 may be in communication with connector 96, which in turn may be connected to the third of the hydraulic fluid connectors 25, and from there to a hydraulic fluid first and second reservoirs 62,62' to actuate the treatment fluid canisters in so far as provided in the tool.

The valves may be controlled electrically. To activate the press device(s), three-way valve 92 is selected to open pump 91 to connector 95 and block the connection to the pressure-compensated reservoir 90. At the same time, three-way valve 93 is in opposite position, blocking the connection with the pump 91 but opening the connection to the pressure-compensated reservoir 90. This allows circulation of the hydraulic fluid from the pressure-compensated reservoir 90 to the piston bores 56*a*,56*b* and from the piston rod annuli 58*a*,58*b* back into the pressure-compensated reservoir 90. When the piston rods 53*a*, 53*b* are in their end positions, the selectable valve 94 may be opened to open the canister(s) to the pressure of the pump 91 and thereby start the injection of the treatment fluid. The stings may be restored to their retracted positions by reversing the positions of both three-way valves 92 and 93 whereby allowing circulation of the hydraulic fluid from the pressure-compensated reservoir 90 to the piston rod annuli 58*a*,58*b* and from the piston bores 56*a*,56*b* back into the pressure-compensated reservoir 90.

Many variations are possible for the hydraulic circuitry. For example, three-way valves 92 and 93 may be mechanically interlinked so that they mechanically switch in unison. Other variants may include use of a bi-directional pump.

The downhole tool may be used as follows. First, the downhole tool as described above is lowered into the borehole, through the downhole tubular, to a selected depth. Then, at the selected depth, the press device acting on the sting is activated. Thereby the sting is forced in the radially outward direction from the tool housing, through a wall of the downhole tubular, whereby perforating said wall of said downhole tubular. Subsequently, the downhole tool may be retrieved from the downhole tubular by pulling the downhole tool in upward direction through to borehole towards surface. In certain embodiments, prior to retrieving the tool, the treatment fluid may be injected from the downhole tool through the sting into an annulus surrounding the downhole tubular.

At least part of the sting may be retracted prior to retrieving. This can be done by reversing the relative movement of the press device, in longitudinal direction, with respect to the sting. A distal end of the sting, for instance the end cap 41, may stay behind in the wall of the downhole tubular after retrieving the downhole tool as a functional plug.

The present disclosure is not limited to the embodiments as described above and the appended claims. Many modifications are conceivable and features of respective embodiments may be combined. The particular embodiments disclosed above are illustrative only, as the present invention may be modified, combined and/or practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined and/or modified and all such variations are considered within the scope of the present invention as defined in the accompanying claims.

We claim:

1. A downhole tool for perforating of a tubular installed in a borehole in the Earth, comprising:

an elongate tool housing extending around a central longitudinal tool axis;

a first sting-arm combination comprising:

a first sting, movable in a first radially outward direction, away from the central longitudinal tool axis, from a first retracted position to a first extended position whereby the first sting extends to outside the elongate tool housing;

a first bending arm having a first distal end on which the first sting is mounted, said first bending arm at a first proximal end thereof being longitudinally secured stationary relative to the elongate tool housing, whereby the first sting and the first distal end of the first bending arm are movable in unison in a first longitudinal-radial plane from the central longitudinal tool axis;

a second sting-arm combination comprising:

a second sting, movable in a second radially outward direction, away from the central longitudinal tool axis, from a second retracted position to a second extended position whereby the second sting extends to outside the elongate tool housing;

a second bending arm having a second distal end on which the second sting is mounted, said second bending arm at a second proximal end thereof being longitudinally secured stationary relative to the elongate tool housing, whereby the second sting and the second distal end of the second bending arm are movable in unison in a second longitudinal-radial plane from the central longitudinal tool axis;

wherein said first sting-arm combination and second sting-arm combination are arranged side-by-side whereby the first sting and the second sting are positioned in one transverse plane but at mutually differing azimuths around the central longitudinal tool axis; the downhole tool further comprising:

a press device comprising a wedge, configured to act on the first sting to force the first sting in the first radially outward direction from the tool housing, and to simultaneously act on the second sting to force the second sting in the second radially outward direction from the tool housing, the first and second radially outward directions being mutually differing, both transversely to the longitudinal axis, upon relative movement of the wedge, in a longitudinal direction, with respect to the first and second sting;

wherein said wedge comprises a first wedge segment and a second wedge segment, slidingly abutted against said first wedge segment in a longitudinal-radial abutment plane, whereby the first wedge segment is in sliding contact with the first sting-arm combination and whereby the second segment is in sliding contact with the second sting-arm combination, and wherein the first wedge segment and the second wedge segment are free to slidingly move relative to each other in the longitudinal direction when being forced into relative movement with respect to the first and second stings, in longitudinal direction parallel to the central longitudinal tool axis.

2. The downhole tool of claim 1, wherein the first sting is rigidly mounted on the first bending arm and the second sting is rigidly mounted on the second bending arm.

3. The downhole tool of claim 1, wherein the first bending arm is a first spring blade that is elastically loaded as the press device forces the first sting in outward direction and the second bending arm is a second spring blade that is elastically loaded as the press device forces the second sting in outward direction.

4. The downhole tool of claim 1, wherein the press device comprises a first piston and a second piston, which first piston and second piston are both actuated by a hydraulic fluid that is displaced by a pump, wherein the first piston engages with the first wedge segment and the second piston engages with the second wedge segment in order to impart said relative movement of the first wedge segment and the second wedge segment, with respect to the first and second stings, in longitudinal direction parallel to the central longitudinal tool axis.

5. The downhole tool of claim 4, wherein the first sting comprises a first fluid channel within the first sting, to establish fluid communication from within the tool housing to an exterior of the tool housing through the first fluid channel, and wherein the second sting comprises a second fluid channel within the second sting, to establish additional fluid communication from within the tool housing to the exterior of the tool housing through the second fluid channel, and further comprising at least one cannister for storing a treatment fluid, said at least cannister in fluid communication with at least one of the first fluid channel and the second fluid channel, and in selective fluid communication with said pump via a selectable valve which selectively isolates the at least one cannister from the pump or opens the cannister to the pump.

6. The downhole tool of claim 5, wherein the at least one cannister comprises a first cannister and a second cannister, wherein the first cannister is in fluid communication with the first sting with a first treatment fluid connection line which bypasses the second sting, and wherein the second cannister is in fluid communication with the second sting with a second treatment fluid connection line which bypasses the first treatment fluid connection line and the first sting, and wherein both the first cannister and the second cannister are in selective fluid communication with said pump.

7. The downhole tool of claim 6, wherein the selectable valve is configured to selectively isolate both the first cannister and second cannister from the pump or to open both the first cannister and the second cannister to the pump.

8. A method of perforating a wall of a downhole tubular arranged within a borehole in the Earth, said method comprising:

providing a downhole tool comprising:

an elongate tool housing extending around a central longitudinal tool axis;

a first sting-arm combination comprising:

a first sting, movable in a first radially outward direction, away from the central longitudinal tool axis, from a first retracted position to a first extended position whereby the first sting extends to outside the elongate tool housing;

a first bending arm having a first distal end on which the first sting is mounted, said first bending arm at a first proximal end thereof being longitudinally secured stationary relative to the elongate tool housing, whereby the first sting and the first distal end of the first bending arm are movable in unison in a first longitudinal-radial plane from the central longitudinal tool axis;

a second sting-arm combination comprising:

a second sting, movable in a second radially outward direction, away from the central longitudinal tool axis, from a second retracted position to a second extended position whereby the second sting extends to outside the elongate tool housing;

a second bending arm having a second distal end on which the second sting is mounted, said second bending arm at a second proximal end thereof being longitudinally secured stationary relative to the elongate tool housing, whereby the second sting and the second distal end of the second bending arm are movable in unison in a second longitudinal-radial plane from the central longitudinal tool axis;

wherein said first sting-arm combination and second sting-arm combination are arranged side-by-side whereby the first sting and the second sting are positioned in one transverse plane but at mutually differing azimuths around the central longitudinal tool axis; the downhole tool further comprising:

a press device comprising a wedge, configured to act on the first sting to force the first sting in the first radially outward direction from the tool housing, and to simultaneously act on the second sting to force the second sting in the second radially outward direction from the tool housing, the first and second radially outward directions being mutually differing, both transversely to the longitudinal axis, upon relative movement of the wedge, in a longitudinal direction, with respect to the first and second sting;

wherein said wedge comprises a first wedge segment and a second wedge segment, slidingly abutted against said first wedge segment in a longitudinal-radial abutment plane, whereby the first wedge segment is in sliding contact with the first sting-arm combination and whereby the second segment is in sliding contact with the second sting-arm combination, and wherein the first wedge segment and the second wedge segment are free to slidingly move relative to each other in the longitudinal direction when being forced into relative movement with respect to the first and second stings, in longitudinal direction parallel to the central longitudinal tool axis;

lowering the downhole tool into the borehole through the downhole tubular to a selected depth;

at the selected depth, activating the press device acting on the sting, whereby forcing the sting in the radially outward direction from the tool housing through a wall of the downhole tubular whereby perforating said wall of said downhole tubular;

retrieving the downhole tool from the downhole tubular comprising pulling the downhole tool in upward direction through to borehole towards surface.

9. The method of claim 8, further comprising, after activating the press device and prior to retrieving the downhole tool:

injecting a treatment fluid from the downhole tool through a fluid channel within the sting and into an annulus surrounding the downhole tubular.

10. The method of claim 8, wherein said retrieving of the downhole tool comprises retracting at least part of the sting comprising reversing a relative movement of the press device with respect to the sting, in longitudinal direction parallel to the central longitudinal tool axis.

11. The method of claim 10, wherein a distal end of the sting stays behind in the wall of the downhole tubular after retrieving the downhole tool.

12. The method of claim 8, wherein the first sting is rigidly mounted on the first bending arm and the second sting is rigidly mounted on the second bending arm.

13. The method of claim 8, wherein the first bending arm is a first spring blade and the second bending arm is a second spring blade, the method further comprising that is elastically loading the first bending arm as the press device forces the first sting in outward direction, and elastically loading the second bending arm as the press device forces the second sting in outward direction.

14. The method of claim 8, wherein the press device comprises a first piston and a second piston, the method further comprising actuating the first piston and second piston by a hydraulic fluid that is displaced by a pump, wherein the first piston engages with the first wedge segment and the second piston engages with the second wedge segment in order to impart said relative movement of the first wedge segment and the second wedge segment, with respect to the first and second stings, in longitudinal direction parallel to the central longitudinal tool axis.

15. The method of claim 14, wherein the first sting comprises a first fluid channel within the first sting, and wherein the second sting comprises a second fluid channel within the second sting, and further comprising at least one cannister for storing a treatment fluid, said at least cannister in fluid communication with at least one of the first fluid channel and the second fluid channel, and in selective fluid communication with said pump via a selectable valve which selectively isolates the at least one cannister from the pump or opens the cannister to the pump, said method further comprising opening the canister to the pump and thereby establishing fluid communication from within the tool housing to an exterior of the tool housing through the first fluid channel and additional fluid communication from within the tool housing to the exterior of the tool housing through the second fluid channel.

16. The method of claim 15, wherein the at least one cannister comprises a first cannister and a second cannister, wherein the first cannister is in fluid communication with the first sting with a first treatment fluid connection line which bypasses the second sting, and wherein the second cannister is in fluid communication with the second sting with a second treatment fluid connection line which bypasses the first treatment fluid connection line and the first sting, and wherein both the first cannister and the second cannister are in selective fluid communication with said pump.

17. The method of claim 16, wherein the selectable valve is configured to selectively isolate both the first cannister and second cannister from the pump or to open both the first cannister and the second cannister to the pump.

* * * * *